United States Patent [19]

Underwood

[11] 4,269,103

[45] May 26, 1981

[54] ELECTROMAGNETIC PICKUP FOR STRINGED MUSICAL INSTRUMENTS

[76] Inventor: John F. Underwood, 6522 Lenneal Beach Dr., Orlando, Fla. 32810

[21] Appl. No.: 811,721

[22] Filed: Jun. 30, 1977

Related U.S. Application Data

[63] Continuation-in-part of Ser. No. 657,266, Feb. 11, 1976, Pat. No. 4,050,341.

[51] Int. Cl.[3] ..... G10H 3/00

[52] U.S. Cl. ..... 84/1.16; 84/1.15; 84/1.14

[58] Field of Search ..... 84/1.14, 1.15, 1.16; 335/302; 336/233, 110

[56] References Cited

U.S. PATENT DOCUMENTS

| | | | |
|---|---|---|---|
| 2,457,421 | 12/1948 | Warren | 335/302 |
| 3,079,535 | 2/1963 | Schultz | 335/302 |
| 3,207,976 | 9/1965 | Stimler | 336/233 |
| 3,435,610 | 4/1969 | Kueffer | 58/23 R |
| 3,506,897 | 4/1970 | Clifford | 58/23 TF |
| 3,902,394 | 8/1974 | Stich | 84/1.16 |
| 3,983,777 | 10/1976 | Bartolini | 84/1.15 |
| 4,026,178 | 5/1977 | Fuller | 84/1.16 |
| 4,050,341 | 9/1977 | Underwood | 84/1.15 |

*Primary Examiner*—Ulysses Weldon
*Attorney, Agent, or Firm*—Leo Gregory

[57] ABSTRACT

An electromagnetic pickup is provided for musical instruments, particularly of the type having vibrating magnetizable strings, which pickup device includes a permanent rectangular bar magnet having a configured surface adjacent to the magnetizable strings to provide a varying magnetic field effecting respective ones of the strings in accordance with their magnetizability, and a coil surrounding the permanent magnet which may be either of a low or high impedance. Thin metal plates or shims are arranged in the pickup intermediate the configured surface of the bar magnet and the magnetizable strings. Various configurations of the magnet surface are included, each of which in combination with the metal plates achieves the natural tone of the respective strings and enhances the balance therebetween of the pickup output. In a further preferred embodiment, a single rectangular bar, which extends under the strings, except for the treble strings, is covered by a single metal shim having itself a configured shape adjacent the treble strings.

28 Claims, 14 Drawing Figures

ELECTROMAGNETIC PICKUP FOR STRINGED MUSICAL INSTRUMENTS

Figure 1:
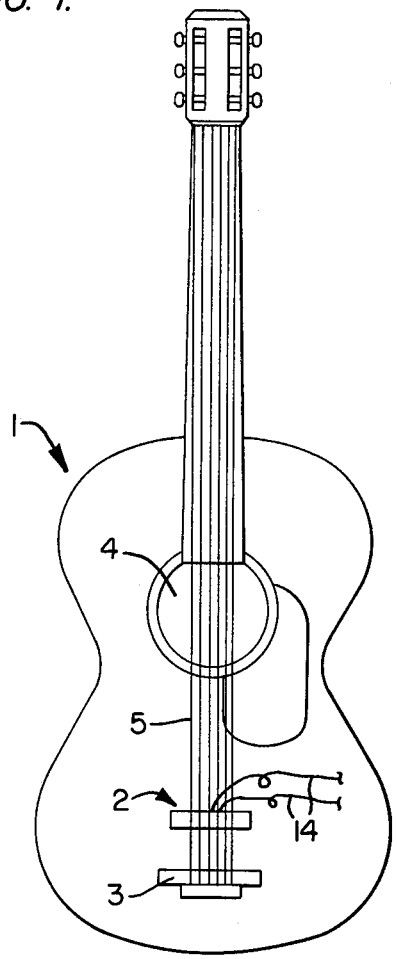

The present application is a continuation-in-part of my copending U.S. patent application, Ser. No. 657,266, filed Feb. 11, 1976 now U.S. Pat. No. 4,050,341, the subject matter of which is hereby incorporated by reference, and the benefit of the earlier filing date is hereby claimed for all common subject matter.

The present invention relates to improved electromagnetic pickups for stringed musical instruments. In this regard, an improvement is provided for the type of pickup, described in my previous application, having a permanent bar magnet with a configured shape or surface adjacent to the strings of the musical instrument for varying the magnetic field effecting the respective strings in accordance with their magnetizability, wherein thin metal plates or shims are interposed between the configured surface of the magnet and the strings. A further improved arrangement of this type is provided wherein the magnet is a regular bar magnet extending beneath only some of the strings, while the metal shim provided between the surface of the magnet and the strings is extended below the remaining strings, not adjacent the magnet, with the shim itself being configured with respect to these strings.

Various arrangements have been contemplated for magnetic pickups for stringed musical instruments for the purposes of achieving volume amplification of the vibrating strings, together with providing an acceptable tone quality and uniformity of the amplified sounds produced by the musical instrument. Such arrangements have included the provision of a plurality of magnetic elements adjacent to each of the strings of the musical instrument which magnetic elements may be adjustable with respect to the strings to achieve natural tones and desired amplification of these tones. Although such arrangements consider the variation of the magnetic field associated with the respective strings, each of which has varying degrees of magnetizability because of their construction, these prior arrangements have involved complex constructions which leave the selection of the tone quality of the strings subject to considerable adjustments.

Other arrangements have contemplated permanent magnet type structures which vary the magnetic field effecting the various strings of the musical instruments by placing a plurality of permanent magnets having variable magnetic polarizations adjacent to the respective strings. These prior arrangements also involve considerably complex constructions. A further prior arrangement for a magnetic pickup for an electric guitar has contemplated the use of separate pickups for the wound and unwound strings of the electric guitar. The diameter of the string, as well as the winding, provide different magnetizability of the wires which are effected by the magnetic field of the respective pickups.

The present invention achieves an improved pickup of the structure of my above-mentioned application in which the natural tone response is provided for each string with high clarity. This electromagnetic pickup, according to the present invention, allows high volume amplification techniques while still retaining a true natural tone for each string, and reducing hum and feedback in the amplified sound of the musical instrument.

Accordingly, these aspects are enhanced efficiently and economically in a relatively simple construction over that of my above-mentioned application in which a permanent magnet having a configured surface adjacent to the strings of the musical instrument for varying the magnetic field effecting the respective strings of the musical instrument was provided, wherein additionally thin metal plates or shims are arranged in the pickup structure between the configured surface and strings.

The configured surface itself provides a varying size of one dimension of a permanent bar magnet in accordance with the degree of magnetizability of the adjacent string. Thus, the magnetic mass adjacent to each respective string is varied in accordance with the magnetization of the string, thereby balancing the response from each string, while achieving a pickup of the natural tone of the string. However, the addition of the thin metal plates, particularly arranged specifically with the respective different sizes of the magnet, results in a considerable improvement in the quality and amplification of the pickup tones.

In particular, the magnetic pickup in accordance with the improved invention advantageously enables the strings of an acoustic guitar to be amplified at a high gain without destroying the natural response and clarity of each string, and considerably reduces hum and feedback of the amplified sound. Accordingly, the acoustic guitar can be electronically amplified while retaining the natural tone quality of each of the strings. An acoustic guitar utilizes bronze strings which are wound, and thereby have varying degrees of magnetization in terms of the magnetic mass and magnetic material of the respective strings. The construction of the magnetic pickup in accordance with the present invention enables a variation of the magnetic field effecting these strings of the acoustic guitar in order to bring out the natural tone without severe amplification of some strings over others such that the response from each string is balanced.

In a particularly preferred arrangement of the present invention, the magnetic mass adjacent the treble strings, which have the smallest diameter and are not wound, is significantly reduced by eliminating the permanent bar magnet at this location, whereas a thin plate covering the bar magnet extends below the treble strings to magnetically balance the pickup from these strings. The portion of the thin plate or shim extending under the treble strings is configured to shape the magnetic field derived from the permanent bar magnet relative to the treble strings, thereby configuring the magnetic field to suit the magnetic pickup of the strings without configuring the bar magnet. This preferred arrangement of the present invention offers the ultimate stability and simplicity of the pickup.

It is an object of the present invention to provide an improved electromagnetic pickup device for a musical instrument of the type having elongated magnetizable vibrating elements, which pickup device achieves a balanced, natural tone quality of the musical instruments at high amplification without the complexities and disadvantages of the above-described prior arrangements.

Another object of this invention is to provide an improved electromagnetic pickup device for musical instruments having elongated magnetizable vibrating elements, which pickup device comprises a permanent magnet having a configured surface adjacent to the magnetizable vibrating elements to provide variation of the magnetic field effecting the respective elements in accordance with their magnetizability, and having a pickup coil surrounding the permanent magnet, wherein the improvement comprises the interposition of thin metal plates or shims between respective configured portions of the configured surface and the vibrating magnetizable elements.

Still another object of the present invention is to provide an improved electromagnetic pickup device of the aforementioned type having the thin metal plates or shims in combination with a pickup device which includes a permanent rectangular bar magnet being magnetically polarized perpendicularly to two edge surfaces of the rectangular bar, with one edge surface adjacent to the vibrating elements being configured to provide a varying cross-sectional thickness or width dimension of the rectangular bar magnet in accordance with the variation of magnetic field effecting the respective vibrating elements with respect to their magnetizability.

A further object of the invention resides in the use of an improved electromagnetic pickup of the aforementioned type having in combination thin metal plates or shims arranged relative to a permanent magnet being configured with different cross-sectional dimensions adjacent the respective strings of an acoustic guitar in accordance with their magnetizability, thereby improving natural tone quality and balance for a pickup of the acoustic guitar at high amplification.

Yet another object of the present invention is to provide an improved electromagnetic pickup device for musical instruments having elongated magnetizable vibrating elements, which pickup device comprises a permanent bar magnet arranged adjacent the vibrating elements of lower degrees of magnetization and a thin plate or shim interposed between the magnet and the vibrating elements with the thin plate extending out from the magnet to balance the magnetic pickup of the vibrating elements of higher degrees of magnetization.

A still further object of this invention resides in an improved electromagnetic pickup of the aforementioned type having a thin metal plate extending out from the permanent magnet to balance the pickup of the less magnetizable vibrating elements, wherein the thin plate is configured relative to the less magnetizable vibrating elements to shape the magnetic field effecting these elements in accordance with their magnetizability.

These and other objects of the present invention may be achieved in an improved electromagnetic pickup device including at least one thin metal plate or shim in combination with a permanent magnet, and having a pickup coil surrounding the permanent magnet and thin metal plate or shim, wherein a configuration of the magnetic field is achieved relative to magnetizable vibrating elements of a musical instrument, either by configuring the magnet or the thin plate or shim. Moreover, the improvement of this combination also resides in that the permanent magnet may be a rectangular bar magnet being magnetically polarized perpendicular to the two longitudinal edge surfaces thereof, and in one embodiment of the present invention, wherein the magnet may have a configured surface with one of the two edge surfaces providing a cross-sectional varying thickness or width dimension of the bar magnet facing the vibrating elements.

In this arrangement of the present invention, the improved pickup may be used with a variation of the cross-sectional thickness or width of the bar magnet being achieved in a tapered form, a step form, a notch form and a combination of a notch and step form. The respective variations of the cross-sectional thickness or width of the permanent magnet are dimensioned in accordance with the amount of pickup to be achieved with the respective strings of the musical instrument. Moreover, it has been found particularly advantageous that respective ones of thin metal plates or shims be placed in relationship to the respective cross-sectional variations of the thickness of the magnet.

A preferred arrangement of these thin metal plates or shims in this embodiment results from using different dimensioned plates or shims relative to the different configured surfaces of the magnet. Thus, at the side of the magnet extending below the treble strings of an acoustic guitar, for example, which magnet has a tapered or stepped configuration of the magnet, a square-like plate or shim can be interposed, while a longer rectangular plate or shim can cover the remaining surface of the magnet. The square-like plate preferably includes a width dimension larger than the width dimension of the longer rectangular plate. By this means, variations in the shielding between the magnet and strings can be balanced so as to result in a more balanced output of the pickup.

This embodiment of the present invention further contemplates the improved pickup with the provision of a covering structure for enclosing the permanent magnet and the coil surrounding the permanent magnet. The thin metal plates or shims may be embedded in the covering structure which may be non-magnetic and include a spacer material which enables a tapering of the surface of the covering structure adjacent to the configured edge surface of the permanent magnet. In this respect, the covering structure can include two non-magnetic plates adjacent the two edge surfaces of the bar magnet, having the pickup coil surrounding the permanent magnet, and connected to one another by means of an epoxy resin further surrounding the construction of the permanent magnet and coil. The epoxy resin material may be also utilized as the spacer material between the top cover plate and the configured surface of the permanent magnet providing a taper therebetween. This top cover and configured surface are those placed adjacent to the strings of the musical instrument.

A further arrangement of this embodiment of the present invention resides in the use of a lead filler as the spacer material between the configured surface of the magnet and the top cover plate. The remaining structure of the pickup is as described with the thin metal plates or shims embedded into the top cover plate above the lead filler material.

In another preferred embodiment of the present invention, the improved combination of the electromagnetic pickup may reside in that the permanent bar magnet may be a rectangular bar magnet being magnetically polarized perpendicular to the two longitudinal edge surfaces thereof, and in that the bar magnet extends only under, or adjacent, the strings of the musical instrument which have the lower magnetization, while a thin metal plate covering the bar magnet extends out from the longitudinal edge surface facing the strings to effect the magnetic field with respect to the strings of higher magnetization, i.e. the treble side strings. In particular, the thin plate is configured or bent in the area adjacent the treble strings to provide a somewhat concave-like surface facing the treble strings. The thickness of the metal plate or shim can be selected to further balance the amount of magnetic energy required for the pickup of the sounds by the treble strings.

A covering structure for this embodiment of the present invention may have non-magnetic plates covering the top and bottom of the bar magnet with the top plate also covering the configured magnetic metal shim or plate. In this arrangement, configured portion of the metal plate extending beyond the magnet may be surrounded by a filler material, such as an epoxy resin or other nonmagnetic material so as to substantially fill the volume between the top and bottom covering plates. The configured metal shim is effectively embedded in position by the filler material so that the pickup coil can be wound about the magnet on one end and about the configured metal shim and filler material at the other end of the pickup device.

The high pickup coil, or spool, plays an important part in the pickup of the tones of the vibrating strings, and may be either low impedance or high impedance. In accordance with a further aspect of the present invention, the coil is wound about the bar magnet having a varying cross-sectional dimension, or about the bar magnet and configured shim, in such a manner as to be tight against the magnet at one end, but wound overlappingly at the end of the pickup relative to the treble side of the musical instrument. Thus, at the treble side, the coil windings are spread-out away from the pickup end, thereby adding depth to the field created by the magnet. This adds depth, or a more distant response, and a pleasing tone to the sounds picked-up at treble side of the musical instrument. On the other hand, the coil windings will be wound tight against the magnet at the bass end which tend to compress the bass tones, thereby reducing super-low frequencies which cause annoying acoustic feedback. This construction acts as a filter of the super-low frequencies at the bass side, while the musical tones picked up at the treble side are mellowed in that the super-high frequencies are limited and not heard as occurs in natural acoustic sounds.

Figure 2:
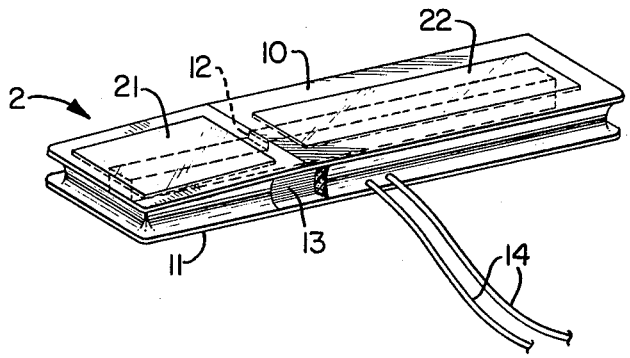
Figure 4A:
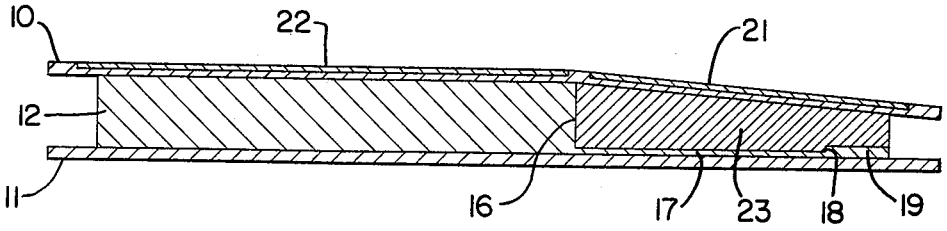
Figure 4B:
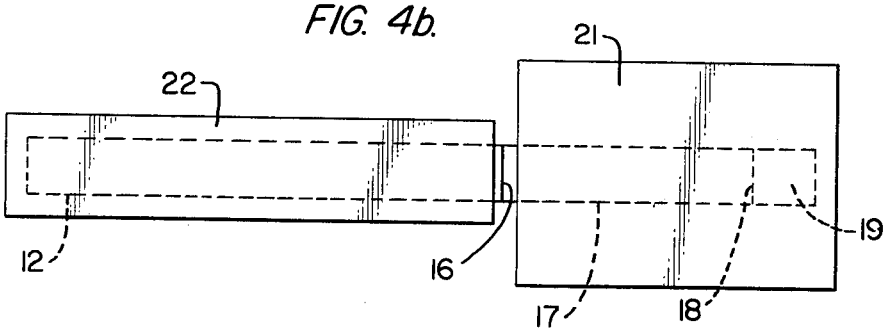
Figure 5A:
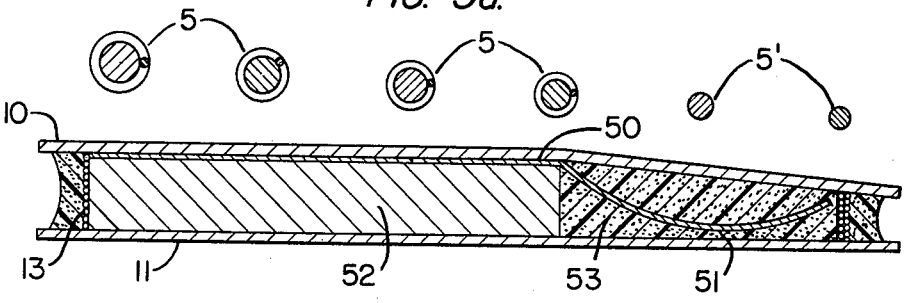
Figure 5B:
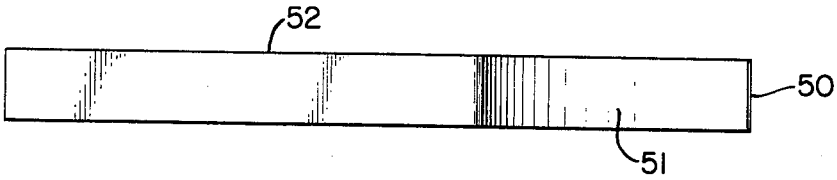
Figure 6:
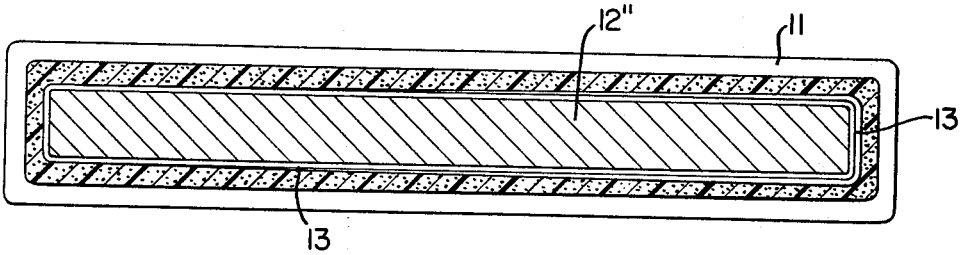

These and other aspects of the present invention may be achieved and understood by reference to the drawing figures, which provide in non-limitative example the features of the present invention, and wherein FIG. 1 illustrates an acoustic guitar utilizing the electromagnetic pickup according to the present invention;

FIG. 2 illustrates in perspective view one embodiment of the improved electromagnetic pickup in accordance with the present invention;

FIGS. 3*a*–3*g* illustrate respective examples of configured cross-sectional thicknesses or widths of the magnet in relation to the strings of a musical instrument for use with the improved electromagnetic pickup device in FIG. 2;

FIGS. 4*a* and 4*b* illustrate a preferred construction of the embodiment in FIG. 2 in elevation and plan view, respectively;

FIGS. 5*a* and 5*b* illustrate in cross-section and plan view, respectively, a preferred construction of another embodiment in accordance with the present invention; and FIG. 6 illustrates an arrangement of the pickup coil of the present invention.

An electromagnetic pickup 2 in accordance with the present invention is illustrated in FIG. 1 being placed under the strings 5 of an acoustic guitar 1. The placement of the pickup may be between the bridge 3 of the guitar and the sound hole thereof with a preferred placement being approximately two inches from the bridge 3 and between the top of the guitar 1 just below the strings 5.

FIG. 2 sets forth an arrangement of one embodiment of the electromagnetic pickup of the present invention in which two thin metal plates or shims 21 and 22 are placed in the top cover 10 of nonmagnetic material. The remaining pickup structure in accordance with my aforementioned copending patent application includes the bar magnet 12 having a generally rectangular shape with respective length, width and thickness dimensions, being provided between the top and bottom covers 10 and 11. The coil 13 surrounds the outer periphery of the bar magnet 12 and includes the leads 14 which may be attached to conventional amplifying equipment including pre-amplifiers.

The thin metal plates or shims 21 and 22 are illustrated in FIG. 2 as being embedded into the top cover plate 10, but this top plate may be dispensed with. In such an arrangement, the pickup is encapsulated in a synthetic resinous material, and the thin metal plates or shims 21 and 22 are arranged over the top of the magnet 12 embedded into the encapsulating material. Thus, the top cover, as well as the bottom cover, may be of a plastic non-magnetic material with the metal plates 21, 22 fixed in the top cover, or alternatively, the top cover may be comprised of the thin metal plates or shims being a metallic magnetic shielding structure.

As may be further seen in FIG. 2, the respective thin metal plates or shims 21 and 22 are of different sizes. That is, the plate 22 is an elongated rectangular plate while the plate 21 is a generally square plate having width dimensions greater than that of the width dimension of the plate 22. Moreover, the magnet 12 in FIG. 2 is illustrated as including a single step, similar to the arrangement in FIG. 3*c*, and the thin metallic plate 21 covers the area of reduced cross-sectional thickness of the magnet, while the thin metallic plate 22 covers the greater thickness portion of the magnet 12. By such an arrangement, the thin metallic plate or shim being at the treble side of the pickup increases the magnetic shielding and/or improves the balance of the pickup with respect to the remaining strings of the guitar.

Various configurations of the bar magnet have been found to be effective in achieving the high volume amplification of the acoustic guitar strings in accordance with the improved structure including the thin metallic shims 21 and 22. These various configurations of the bar magnet may be seen by reference to FIGS. 3(*a*–*g*), which correspond to the various configurations utilized in my abovementioned copending application.

Figure 3A:
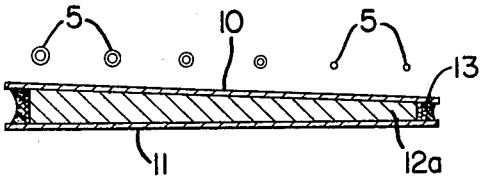
Figure 3B:
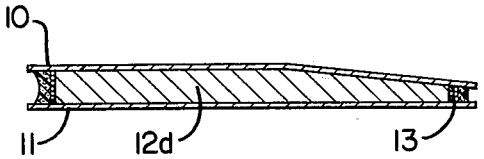

Accordingly, the rectangular bar magnet 12*a* in FIG. 3*a* has a tapered edge surface adjacent to the strings of the guitar in order to provide a continuously varying change of magnetic mass adjacent to the strings 5, which includes steel wound bronze strings at the base side and unwound steel strings at the treble side. A further example of this structure is seen in FIG. 3*b* in which the taper is provided only over a length of the bar magnet 12*b* at the treble side of the pickup.

Figure 3C:
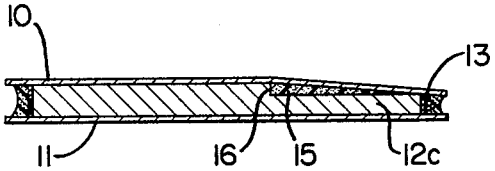

The configured bar magnet 12*c* in FIG. 3*c* includes a step 16 at the treble side of the pickup. In this instance, a spacer material may be placed between the face 15 of the reduced step cross-sectional portion of the magnet 12*c* with the thin metallic plate or shim, such as 21, placed thereabove, similarly to that illustrated in FIG. 2. As mentioned above, the shim 21, as well as shim 22 may be provided above the magnet, between the top surface of the magnet and the strings 5, with or without the use of the top cover 10.

Figure 3D:
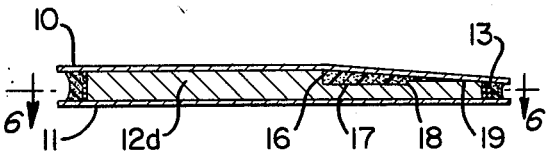

A further arrangement of the bar magnet may be seen in FIG. 3*d*, wherein the bar magnet 12*d* is stepped at the step 16, and further includes a notch edge surface portion 17 with a further step edge surface portion 19 at the step 18. In this respect, the thin metallic shim 21 may cover the major portion of the notch edge surface portion 17, as well as the edge step surface portion 19, as may be further seen in FIGS. 4*a* and 4*b*.

Figure 3E:
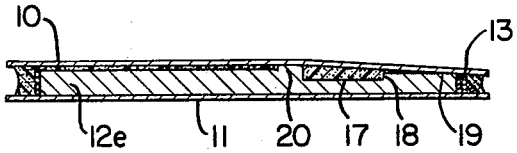
Figure 3F:
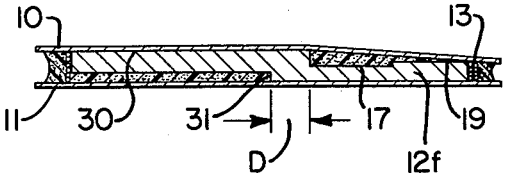
Figure 3G:
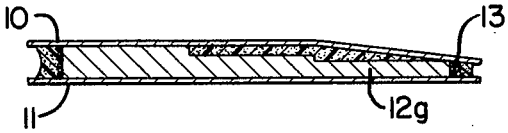

The pickup in FIGS. 3*e*, 3*f*, and 3*g* show various other configurational arrangements of the bar magnets 12*e*, 12*f*, and 12*g*. In these various configurational arrangements of the magnets, respective different thicknesses of the magnet are disposed relative to the different strings of the guitar. Moreover, each of these configurational arrangements of the bar magnets in FIGS. 3*a* through 3*g* may be appropriately dimensioned in accordance with the strings of the guitar, as described in my aforementioned copending patent application.

In this respect, the various configurational arrangements of the bar magnets result in differing advantageous features of the pickup of the present invention, as discussed in my copending application. For example, ease of manufacture, as well as varying balanced outputs of the pickup, may be achieved with the respective different configurational arrangements of the bar magnet.

FIGS. 4*a* and 4*b* illustrate in respective elevational and plan views a preferred arrangement of this embodiment of the present invention in which the thin metal plates or shims 21 and 22 are arranged above the top surface of the configured bar magnet. In these figures, a configuration of the bar magnet, such as appears in FIG. 3*d*, is provided with the shims 21 and 22 being embedded into the top cover 10.

In this regard, FIG. 4*a* illustrates the embedding of the shims 21 and 22 into the top cover 10, and a filler material 23 included between the top cover 10 and the stepped surfaces 17 and 19 of the bar magnet 12. This filler material may be lead, and the pickup then embedded in a synthetic resinous material with the coils wrapped around the edges of the magnet.

FIG. 4*b* shows in plan view the arrangement of this embodiment of the present invention wherein the covers 10 and 11 are not illustrated for purposes of clarity. This figure also emphasizes the difference in dimensions of the respective thin meallic plates or shims 21 and 22, as well as their respective placement with respect to the stepped or configured surfaces of the pickup.

Although this preferred arrangement in FIG. 4 is described with respect to the bar magnet, such as that in FIG. 3*d*, of course, the shims 21 and 22 may be utilized with any of the different configured magnets, such as those previously described.

In each of the embodiments described above, the bar magnets may have a cross-sectional thickness ranging from 0.125 to 0.425 inches. Moreover, the permanent bar magnets may be formed of a rubber magnetic material, an alnico magnetic material, a Cu-Ni-Fe magnetic alloy, or a ceramic magnet. The length of the magnet will be appropriate to extend under all of the strings of the guitar, and may be approximately 2½ inches, for example.

The thin metallic plates or shims will have corresponding dimensions appropriate to the improvement of these elements. Namely, in the embodiment of FIGS. 4*a* and 4*b*, for example, the thin metallic plate or shim 21 may be generally one square inch, while the thin metallic rectangular plate 22 may have a length slightly greater than about 1½ inches and a width somewhat less than one inch.

The metal plates or shims may be formed of steel or preferably any magnetic shielding material.

A preferred embodiment of the present invention is illustrated in FIGS. 5*a* and 5*b*, wherein the magnet 52 extends only beneath the strings 5 of lower magnetizability, and the thin plate or shim 50, covering the top of the magnet, extends from the magnet to below the strings 5' of higher magnetizability. These strings are at the treble side of the musical instrument, and are constituted of small diameter and are not wound, so as to have a high degree of magnetizability. Thus, in order to achieve excellent balance for these strings which require only a small amount of magnetic energy, then the metal plate 50 being magnetized by the magnet 52 effects only the magnetic field necessary for the strings 5'.

In this regard, in order to improve the pickup, the thin plate 50 extending beyond the magnet 52 is configured by a dip or bend 51. This achieves a variation of the magnetic field relative to the strings 5' in a similar manner to that of the configured bar magnet 12 in the embodiment above, but with a much simpler construction achieved with a higher degree of stability. As may be seen in FIG. 5*a*, the volume between the upper and lower cover plates 10 and 11 is filed with a filler 53, which may be of an epoxy resin material, or a similar filler material to that described in the embodiment above.

This filler material 53 embeds the configured portion 51 of the shim 50 so as to hold it into position, as well as provides a base or support for winding the coils 13 about the end of the freely extending shim 50. The magnet may be of the same magnetic material used in the embodiment discussed above, while the cover plates 10 and 11 may also be of non-magnetic synthetic resinous materials or non-magnetic metals, which are bonded together by an encapsulating material, such as described above. The thin metal plate or shim 50 may be formed of a steel or a magnetic material, as above, and preferably has a thickness of about 0.030 inches. The rectangular dimensions of the thin plate or shim 50 correspond to that of the magnet, as may be seen in FIG. 5*b*, wherein the magnet may have a length of about 1½ inches, for example, wich a width or thickness similar to that described above.

On the other hand, the shim 50 extends beyond the edge of the magnet 52 sufficiently to be located beneath the strings 5', such as by a distance of at least one inch. Moreover, the curvature 51 of the plate 50 in this area may be determined on the basis of the balance of the magnetic pickup of the strings 5'. As may be seen in FIG. 5*a*, the curvature is such as to provide a concave-like surface facing the strings 5' with the distance between the strings and the shim 50 varying in accordance with the magnetizability of the respective strings. That is, the shim 50 is farthest away from the larger diameter string having a greater magnetic mass than the right-hand most string.

The arrangement of the coil 13 has been found to be of considerable importance in the quality of the pickup in both embodiments of the present invention, as also discussed in my aforementioned copending patent application. Accordingly, FIG. 6 shows a view of the pickup in FIG. 3*d* in the direction of the arrows 6—6 wherein the coil 13 may be wound above the bar magnet 12'' to be tight against the magnet at the wider dimension end, or base side, while being wound spreadout away from the magnet at the outer width end, or treble side. This winding occurs as a natural consequence of the winding of the wire about the magnet of different widths in order to maintain the presence of the coil about the body of the magnet. A similar arrangement of the coil windings may be seen in FIG. 5*a*.

This arrangement of FIG. 6 has been found to considerably enhance the quality of the acoustic pickup in that the super-high frequencies of the treble side, as well as the super-low frequencies of the base side, are essentially filtered out.

In each of the embodiments of the present invention, the coil may be a low impedance coil of about 150 to 1000 ohms, and, for example, may be No. 37 wire with an impedance of about 200 ohms. The size or gauge of the wire may vary considerably, however, ranging from No. 37 wire to No. 44 wire with a corresponding impedance ranging from 200 to 1000 ohms. Also, a high impedance coil of from 6000 to 14000 ohms for wire ranging from No. 40 to No. 44 may be used.

While I have shown and described several embodiments in accordance with the present invention, it is understood that the same is not limited thereto, but is susceptible to numerous changes and modifications as may be known to a person skilled in the art, and I therefore do not wish to be limited to the details shown and described herein, but intend to cover all such changes and modifications as are obvious to one of ordinary skill in the art.

I claim:

1. An electromagnetic pickup device adapted for musical instruments having elongated magnetizable vibrating elements with each of said vibrating elements having a different degree of magnetizability, said pickup device comprising:

(a) a single permanent rectangular bar magnet adapted to be disposed adjacent to vibrating elements having a lower degree of magnetizability, and (b) a pickup coil surrounding said permanent magnet; the improvement comprising:

at least one metal plate means for varying the magnetic field of said permanent magnet in proportion to the degree of magnetizability of said vibrating elements; said metal plate means being adapted to be interposed between said permanent magnet and said vibrating elements, and extend from said magnet below said vibrating elements having a lower degree of magnetizability; whereby said magnetic field is varied in accordance with the magnetization of said vibrating elements thereby balancing the response from each vibrating element while achieving a pickup of the natural tone of each of said vibrating elements, and said metal plate means is configured to provide a concave like surface facing said vibrating elements of higher degree of magnetizability.

2. The structure of claim 1, wherein said one metal plate means is embodied in a non-magnetic filler material.

3. The structure of claim 1, wherein said pickup coil includes conducting means wound around said magnet and filler material embedding said one of said metal plate means.

4. The structure of claim 1, including covering means enclosing said permanent magnet, said metal plate means and said pickup coil, and said covering means including covering plates connected by an encapsulating material.

5. In an electromagnetic pickup device adapted for musical instruments having elongated magnetizable vibrating elements with each of said vibrating elements having a different degree of magnetizability; wherein said pickup device comprises:

(a) a single permanent magnet having a configured surface adapted to be disposed adjacent to all of said magnetizable vibrating elements; and (b) a pickup coil surrounding said magnet; the improvement comprising:

configured permanent magnet surface means and metal plate means for varying the magnetic field of said permanent magnet in proportion to the degree of magnetizability of said vibrating elements, with at least two metal plates being adapted to be interposed between said configured surface and said magnetizable vibrating elements; whereby said magnetic field is varied in accordance with the magnetization of said vibrating elements thereby balancing the response from each vibrating element while achieving a pickup of the natural tone of each of said vibrating elements, and said permanent magnet has a predetermined length and width dimension and being magnetically polarized perpendicularly to said configured surface means, said surface means being a configured edge surface along said length dimension, and said surface means providing a varying width dimension of said bar magnet to face said vibrating elements.

6. The structure of claim 5, wherein a first of said two metal plates is disposed above said configured edge surface at a portion of reduced width dimension, and a second of said two metal plates is disposed above said configured edge surface at a portion of relatively larger width dimension.

7. The structure of claim 6, wherein at least a portion of said configured edge surface is tapered to provide a tapered portion of said reduced width dimension of said bar magnet.

8. The structure of claim 6, wherein said configured edge surface is tapered.

9. The structure of claim 6, wherein said configured edge surface includes step edge surface portions providing stepped portions of said reduced width dimensions of said bar magnet.

10. The structure of claim 9, wherein said step edge surface portions provide at least two different width dimensions of said bar magnet.

11. The structure of claim 10, wherein said first of said two metal plates is disposed above the step edge surface portion having the lesser of said two different width dimensions has a square shape, said second of said two metal plates has an elongated rectangular shape, and the width dimension of said square shape is greater than the width dimension of said rectangular shape.

12. The structure of claim 6, wherein said configured edge surface includes at least one notch edge portion providing said reduced width dimensions.

13. The structure of claim 12, wherein said notch edge surface portion provides at least three different width dimensions of said bar magnet, said second of said two metal plates being disposed above the largest width dimension, and said first of said two metal plates being disposed above the remaining width dimensions.

14. The structure of claim 5, wherein said configured edge surface includes notch and step edge portions.

15. The structure of claim 14, wherein said notch and step edge portions provide at least four different width dimensions.

16. The structure of claim 15, wherein said first of said two metal plates is disposed above the smaller of said four different width dimensions, and said second of said two metal plates is disposed above the larger of said four different width dimensions.

17. The structure of claim 14, wherein the edge surface of said bar magnet is configured opposite to said configured surface adjacent said vibrating elements.

18. The structure of claim 17, wherein said two configured edge surfaces provide at least four different width dimensions of said bar magnet.

19. The structure of claim 18, wherein said first of said two metal plates is disposed above the smaller of said four different width dimensions, and said second of said two metal plates is disposed above the larger of said four different width dimensions.

20. The structure of claim 6, wherein said coil includes conducting means wound against said magnet at an end having larger width dimensions, and said conducting means being overlappingly wound upon itself at an end of said magnet having smaller width dimensions.

21. The structure of claim 5, including covering means enclosing said magnet and said coil, comprising a first plate covering said configured surface, and a spacer between at least a portion of said configured surface and said first plate providing a taper therebetween.

22. The structure of claim 21, wherein at least two metal plates are embedded in said first plate,

23. The structure of claim 21, wherein said spacer includes lead material.

24. The structure of claim 22, wherein said two metal plates comprises thin steel shims.

25. In an electromagnetic pickup device for musical instruments having elongated magnetizable vibrating elements with each of said vibrating elements having a different degree of magnetizability; wherein said pickup device comprises:

(a) a single permanent magnet, and (b) a pickup coil surrounding said magnet; the improvement comprising:

horizontal plate means for varying the magnetic field of said permanent magnet in proportion to the degree of magnetizability of said vibrating elements; said horizontal plate means is disposed adjacent to said magnet; whereby the magnetic field of said magnetic is shaped by maximizing the magnetic field adapted to effect the wound vibrating elements having a lower degree of magnetizability and minimizing the magnetic field adapted to effect the vibrating elements having a higher degree of magnetizability, and said plate means is configured to provide a concave-like surface which when said pickup device is adapted to said vibrating elements, will face said vibrating elements of higher degree of magnetizability.

26. The structure of claim 25, wherein said plate means is embedded in non-magnetic filler material.

27. The structure of claim 26, wherein said pickup coil includes conducting means wound around said magnet and filler material embedding said plate means.

28. The structure of claim 27, including covering means enclosing said magnet, said plate means and said pickup coil, and said covering means including cover plates connected by an encapsulating material.

* * * * *